US008836589B2

(12) United States Patent
Monsalve Carcelen et al.

(10) Patent No.: US 8,836,589 B2
(45) Date of Patent: Sep. 16, 2014

(54) FLUSH-MOUNTED LOW-PROFILE RESONANT HOLE ANTENNA

(75) Inventors: Beatriz Monsalve Carcelen, Barcelona (ES); Ramiro Quintero Illera, Barcelona (ES); Alfonso Sanz Arronte, Barcelona (ES); Enrique Martinez Ortigosa, Barcelona (ES)

(73) Assignee: Advanced Automotive Antennas, S.L., Barcelona (ES)

( * ) Notice: Subject to any disclaimer, the term of this patent is extended or adjusted under 35 U.S.C. 154(b) by 729 days.

(21) Appl. No.: 13/063,506

(22) PCT Filed: Sep. 10, 2009

(86) PCT No.: PCT/EP2009/061754

§ 371 (c)(1), (2), (4) Date: May 13, 2011

(87) PCT Pub. No.: WO2010/029125

PCT Pub. Date: Mar. 18, 2010

(65) Prior Publication Data

US 2012/0038525 A1 Feb. 16, 2012

(30) Foreign Application Priority Data

Sep. 12, 2008 (EP) ..... 08164228

(51) Int. Cl.
*H01Q 1/28* (2006.01)
*H01Q 13/18* (2006.01)

(52) U.S. Cl.
CPC ..... *H01Q 1/286* (2013.01); *H01Q 6/0442* (2013.01); *H01Q 13/18* (2013.01)
USPC ..... 343/705

(58) Field of Classification Search
USPC ..... 343/705
See application file for complete search history.

(56) References Cited

U.S. PATENT DOCUMENTS

| | | | | |
|---|---|---|---|---|
| 5,039,992 | A * | 8/1991 | Lenormand et al. | 343/708 |
| 5,465,100 | A | 11/1995 | Remondiere et al. | |
| 6,061,027 | A | 5/2000 | Legay et al. | |
| 2006/0119517 | A1 * | 6/2006 | Futamata | 343/700 MS |

FOREIGN PATENT DOCUMENTS

| | | |
|---|---|---|
| EP | 0 399 525 | 11/1990 |
| EP | 0 899 814 | 3/1999 |
| WO | 01/41257 | 6/2001 |
| WO | 2005/069442 | 7/2005 |

OTHER PUBLICATIONS

International Search Report dated Oct. 22, 2009, from the corresponding International Application.

* cited by examiner

*Primary Examiner* — Kristy A Haupt
(74) *Attorney, Agent, or Firm* — Katten Muchin Rosenman LLP

(57) ABSTRACT

The invention relates to a flush-mounted aircraft, UAV or missile antenna system, which is an integral part of the fuselage (3) of an aircraft, UAV or missile. The antenna system comprises a surface (3) made of a conductive material and a resonant recess (4) formed in said conducting surface, wherein said recess is conformed to provide a resonant behavior in a selected operating frequency, the antenna system further comprising a radiating element (2) located within said recess and a feeding element (5) within said recess coupled to said radiating element.

15 Claims, 12 Drawing Sheets a b

FLUSH-MOUNTED LOW-PROFILE RESONANT HOLE ANTENNA

OBJECT OF THE INVENTION

An object of this invention is to provide a flush-mounted aircraft, UAV or missile antenna system, that is an integral part of the fuselage of an aircraft, UAV or missile.

BACKGROUND OF THE INVENTION

Monopole antennas are currently used in high speed and ultra high speed aircrafts, unmanned aerial vehicles (hereinafter UAVs), missiles, etc. These antennas are normally blade antennas like the one described in FIG. 1. Blade antennas are designed in such a way that the external blade element is attached to the skin of the aircraft, UAV or missile, and extending outwardly therefrom.

The blade antenna shape may affect the aerodynamic performance of high speed and ultra high speed aircrafts, UAVs, missiles, etc. The presence of a blade antenna on the fuselage of the aircraft, UAV or missile may cause problems such as fluid dynamic disturbances, aircraft, missile or UAV vibrations that can affect the antenna performance, or even destroy the antenna itself and heat due to friction that may alter the antenna performance or damage the antenna elements.

The use of blade antennas is normally intended in order to assure a monopole-like radiation pattern as presented in FIG. 2 where an omnidirectional radiation pattern in the horizontal plane is needed.

SUMMARY OF THE INVENTION

An object of this invention is to provide a flush-mounted aircraft, UAV or missile antenna system intended to replace standard fuselage-mounted blade antennas with similar or superior performance.

A second object of the present invention is to provide such a flush-mounted antenna with a low-profile resonant hole integrated on the aircraft fuselage that conforms to the shape of the aircraft, UAV or missile.

This resonant hole is made of conductive material, using the same material of the fuselage of the Aircraft, UAV or missile, so it can be integrated on the manufacturing process of such a fuselage. The resonant hole wall's shape need not to be circular, however, any change on the shape of the resonant hole will affect the antenna performance.

The resonant hole may have circular shape with a radius smaller than 1.5 wavelengths. The wall of the resonant hole is much smaller than one wavelength thus creating a low-profile structure.

The invention provides such an antenna resonant hole with a radiating element mounted on the resonant hole and flush-mounted to the aircraft fuselage, and separated from the fuselage by an air or dielectric-filled gap.

The invention provides such a radiating element with a coupling feeding element, located inside the antenna resonant hole that excites the radiating element thus creating the desired omnidirectional radiation pattern.

The invention is realized in a low-profile conformed resonant hole antenna which is integral part of the fuselage of the aircraft, UAV or missile, so an aerodynamic flush-mounting is achieved. The resonant hole height is small when compared with the wavelength of the frequency of operation of the antenna.

The antenna resonant hole is part of the fuselage of the aircraft, UAV or missile so it is built with the same conductive material of the fuselage (carbon fiber, titanium, aluminium, etc) of the aircraft, UAV or missile.

A radiating element is used to excite the resonant hole and create the desired radiation pattern. This antenna element presents the dimensions needed in order to resonate at the frequency of interest. The radiating element is conductively coupled to the feeding system, so the gap between the feeding system and the radiating element can be modified in order to change the antenna bandwidth.

The radiating element can be constructed with the same material of the fuselage of the aircraft, UAV or missile, so the antenna can be integrated as a part of the fuselage when building the fuselage itself, or can be delivered as a separate component made with appropriate materials.

BRIEF DESCRIPTION OF THE DRAWINGS

—FIG. 3*a* is a perspective image of the flush-mounted low-profile resonant hole antenna system of the invention on one of its multiple embodiments, and FIG. 3*b* is a top plan view of the flush-mounted low-profile resonant hole antenna of FIG. 3.

DETAILED DESCRIPTION OF THE INVENTION

Figure 1:
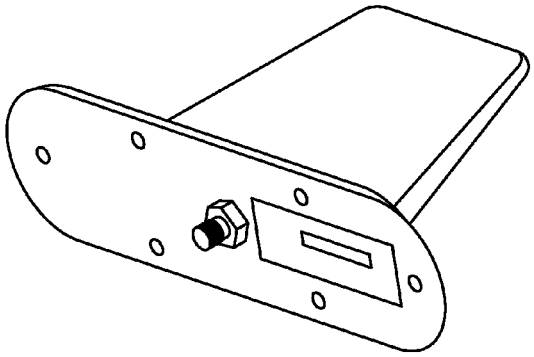
FIG. 1 (Prior Art)
FIG. 1.—presents a prior-art blade-type monopole antenna that is mounted on the fuselage of an aircraft, UAV or missile, and extending outwardly therefrom.
Figure 2:
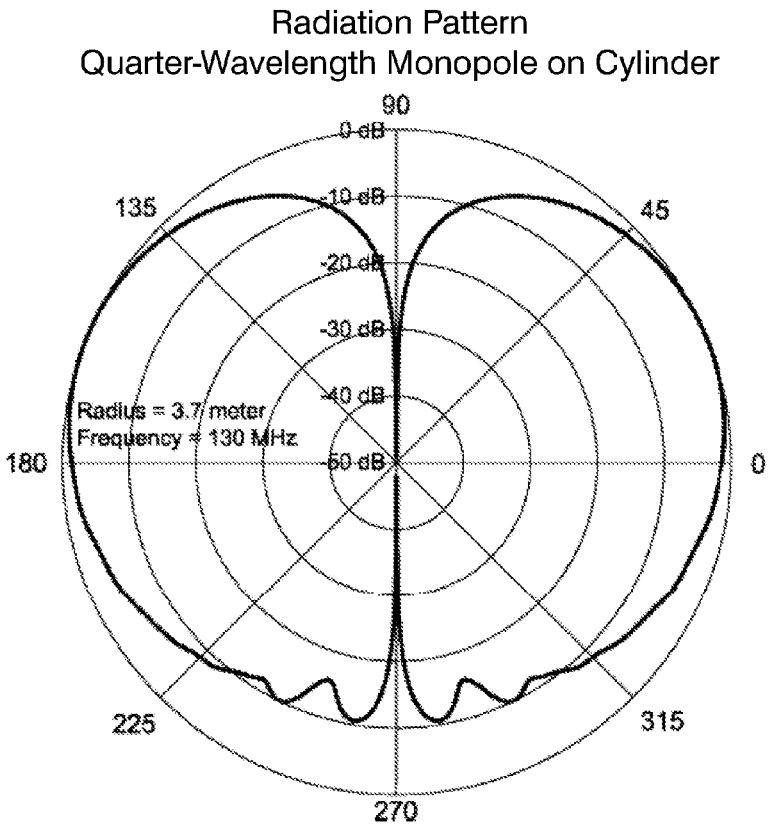
FIG. 2 (Prior Art)
FIG. 2.—is a radiation pattern of a blade-type antenna (a quarter-wavelength monopole on cylinder) when mounted on a structure similar to a fuselage of an aircraft, UAV or missile.

The flush-mounted low-profile resonant hole antenna system of the invention is intended to be, completely or partially, an integral component of the fuselage (3) of an aircraft, UAV or missile.

The antenna system of the invention comprises a surface (1) made of a conductive material and a resonant recess (4)

formed in said conductive surface (1). Said recess (4) is an open cavity extending inwardly in said surface, and it is defined by a side wall (6) in the entire perimeter of the cavity, and a bottom wall (7).

The antenna system further comprises a radiating element (2), so that a major part of the radiating element is housed within said recess. This means that, preferably a major part of the radiating element is housed within the volume defined by said recess.

A feeding element (5) is provided also within said recess, separated from the radiating element but electromagnetically coupled the radiating element to feed it with an electromagnetic signal.

The shape and dimensions of the recess is conformed to provide a resonant behaviour in a selected operating frequency, together with the shape and dimensions of the radiating element.

Figure 5A:
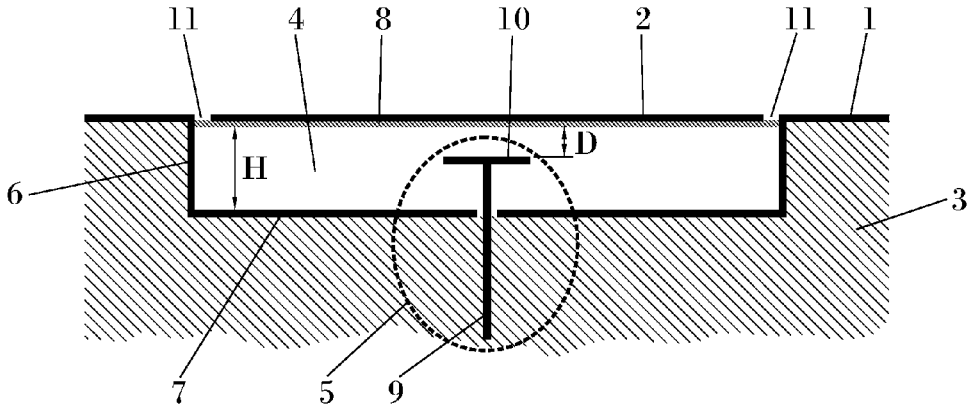
FIGS. 5*a* through 5*c* show different sectional views of the flush-mounted low-profile resonant hole antenna and its main components.
Figure 5B:
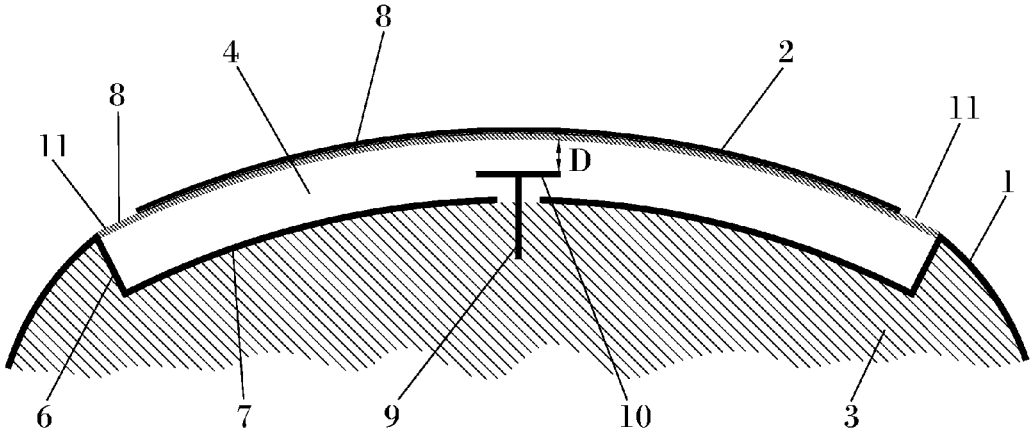
Figure 5C:
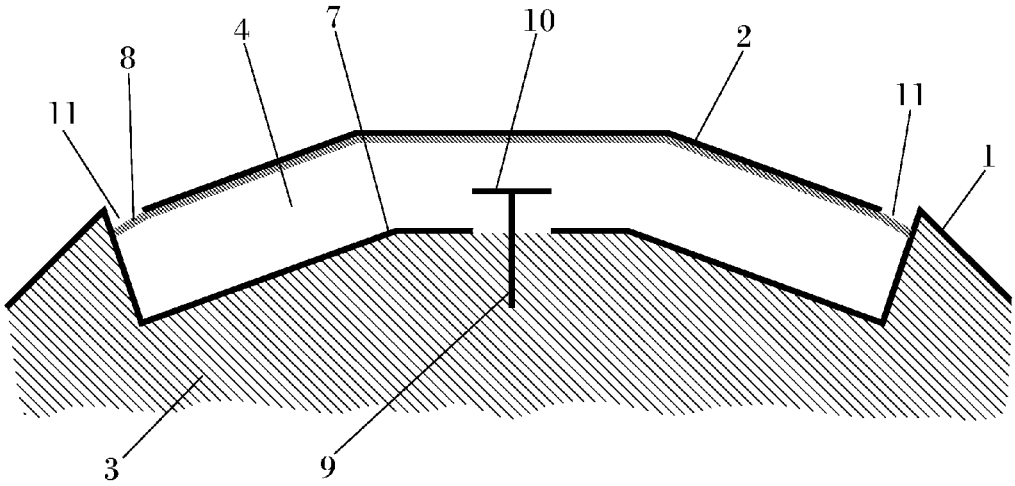
Figure 6:
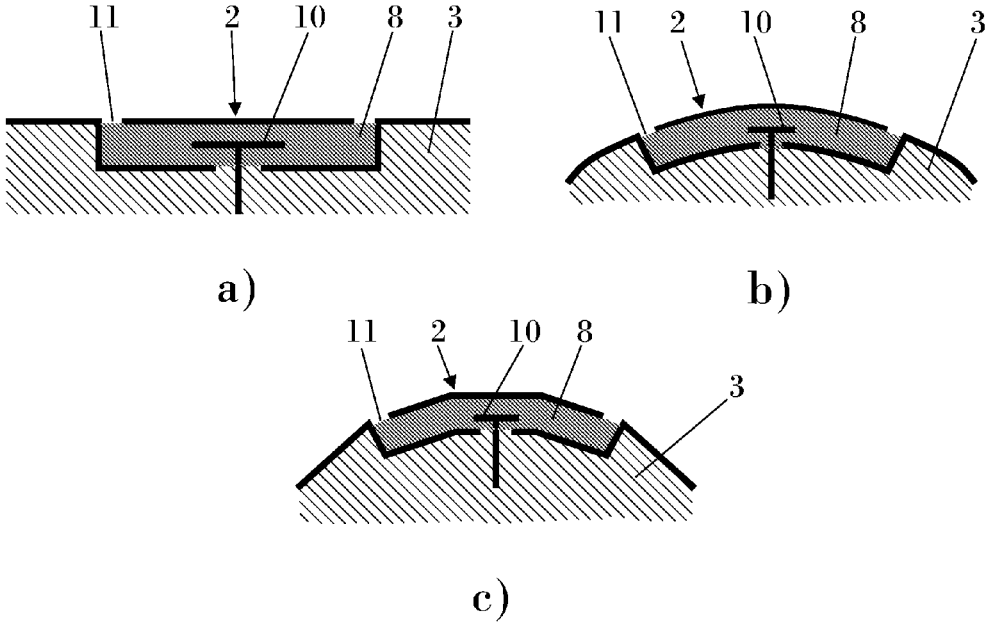
FIGS. 6*a* through 6*c* show different sectional views of the flush mounted low-profile resonant hole antenna and its main components. In the case of FIGS. 6*a* and 6*c*, the resonant hole is completely filled with low-loss dielectric material.

The radiating element (2) is a laminar body and it is flush-mounted with respect to the surface (1), as shown for instanced in FIGS. 5 and 6, that is the radiating element is at the same level than the surface. This means that the radiating element is arranged at the aperture of the recess (4), and its shape is a continuation of the shape of the surface (1).

The radiating element (2) is supported by a dielectric carrier (8) which fills the resonant hole completely (as shown in FIG. 6*a*) or only in part (as shown in FIG. 5*a*). In turn, the dielectric carrier (8) is supported in the walls of the resonant hole. The radiating element is separated from the conductive surface (1) by means of a gap (11). This gap (11) extends along the entire perimeter of the radiating element.

Preferably, the feeding system (5) has a feeding pin (9) and a coupling plate (10) which is capacitively coupled with the radiating element (2). The coupling plate is substantially parallel to the radiating element (2).

The resonant hole is made of the same conductive material like the one used on aircraft, UAV or missile fuselages, for example: Carbon fibre, titanium, aluminium, etc, that is, the side or perimetric wall (6) and the bottom wall (7), are made of same conductive material like the one used on aircraft, UAV or missile fuselages (Carbon fibre, titanium, aluminium. The fuselage can be fabricated in such a way that includes the flush-mounted low profile resonant hole antenna completely, so there is no need of external components to be attached.

Another option is that the fuselage can be constructed in such a way that includes parts of the flush-mounted low-profile resonant hole antenna like the low-profile resonant hole and the feeding system. In this case, the radiating element will be delivered as an external component that can be attached to the resonant hole by appropriate means.

Figure 3:
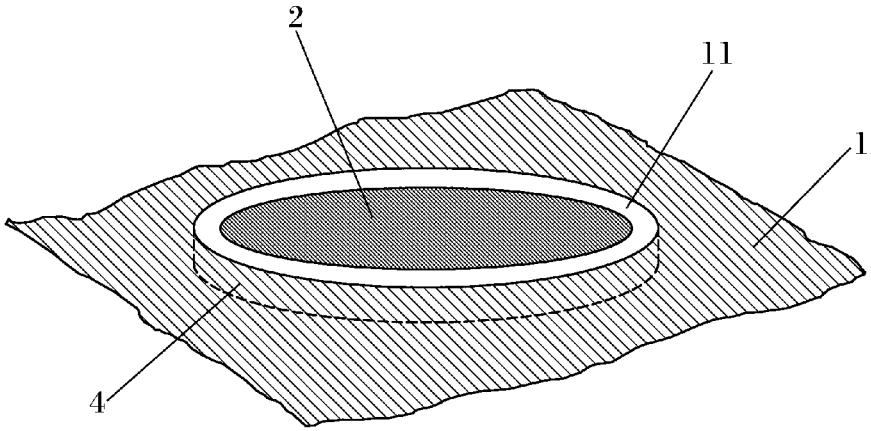
FIG. 3.
Figure 3:
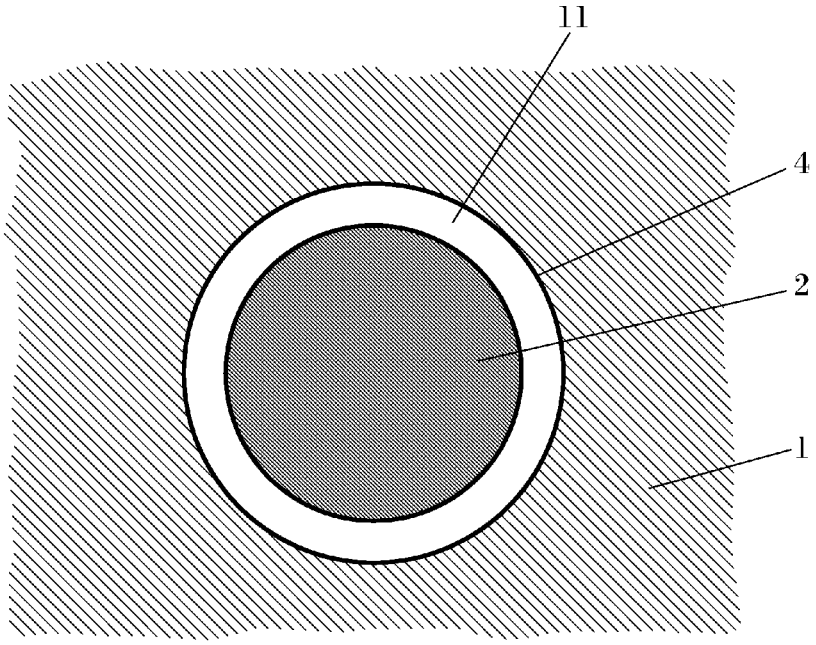
Figure 4A:
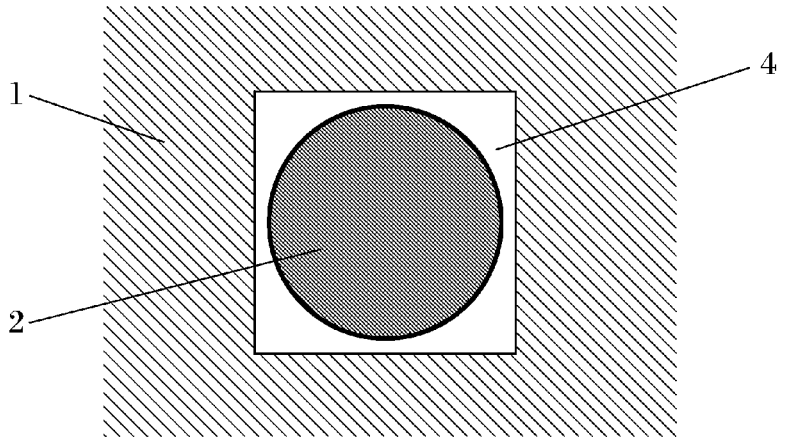
FIG. 4*a* through 4*j*.—show a top plan view of several configurations of the antenna system.
Figure 4B:
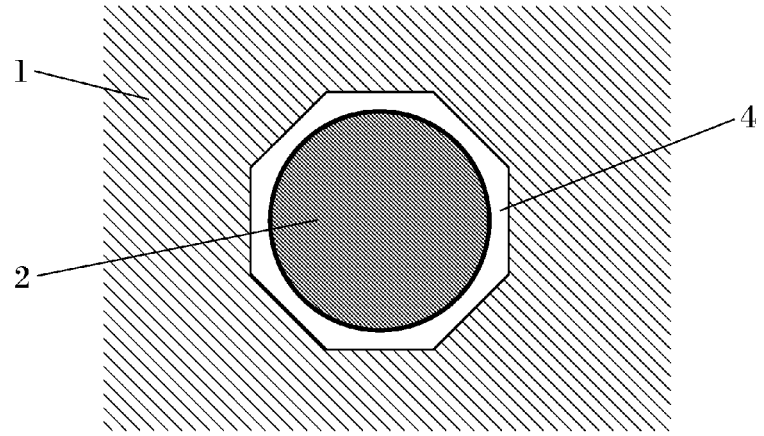
Figure 4C:
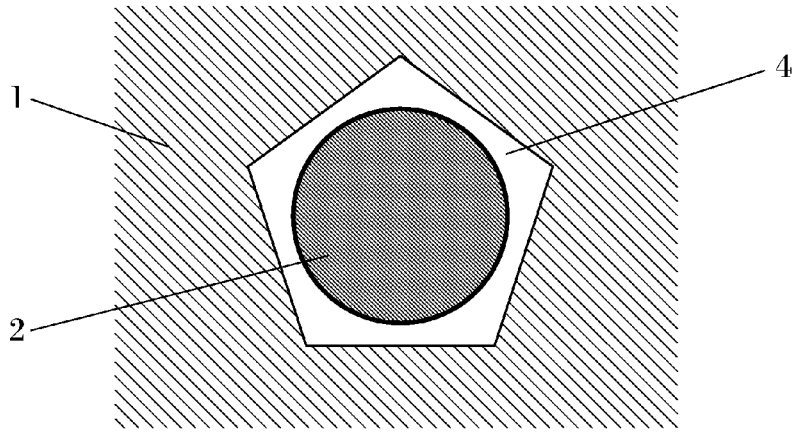
Figure 4D:
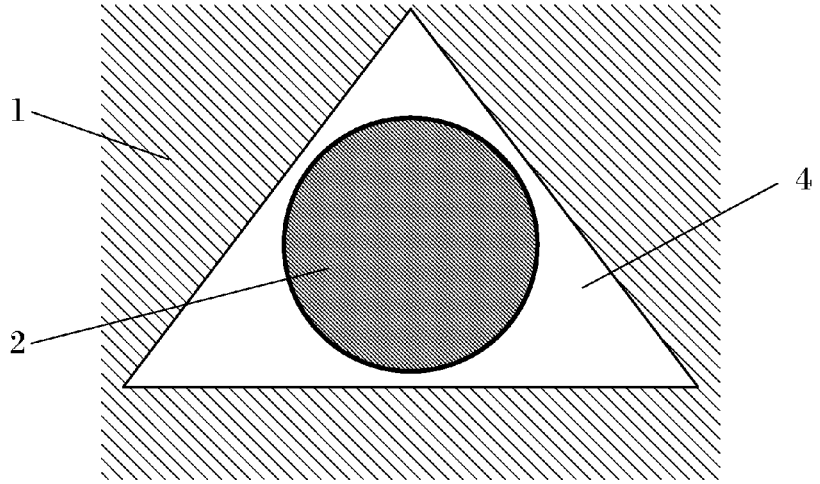
Figure 4E:
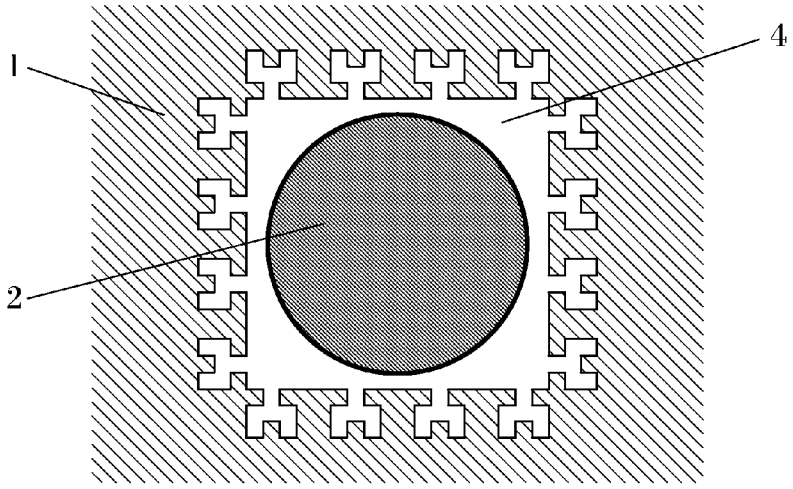
Figure 4F:
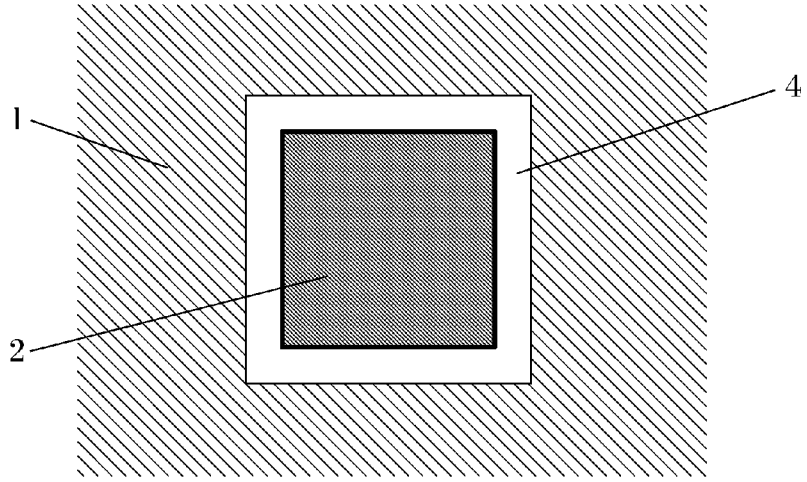
Figure 4G:
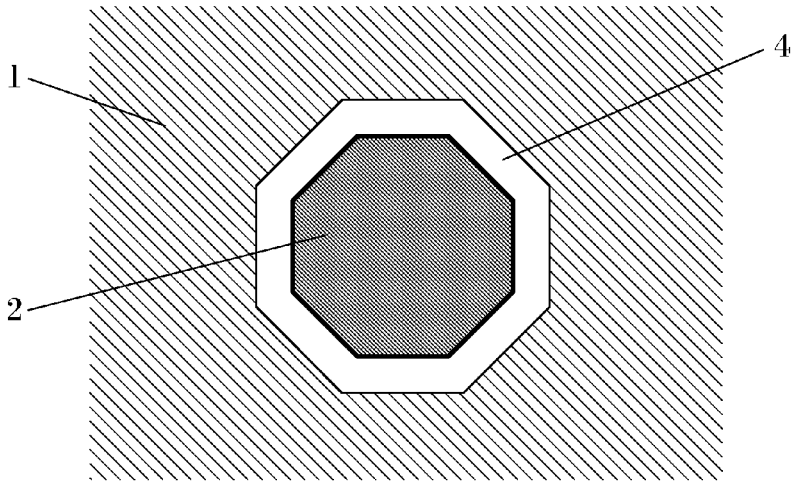
Figure 4H:
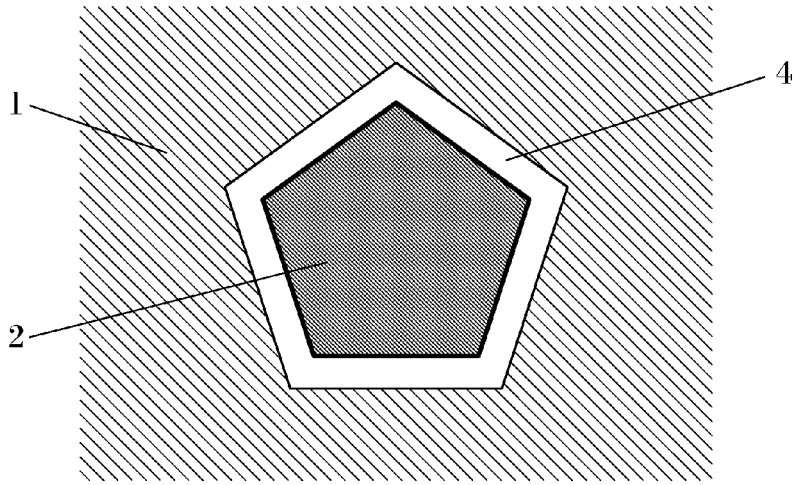
Figure 4I:
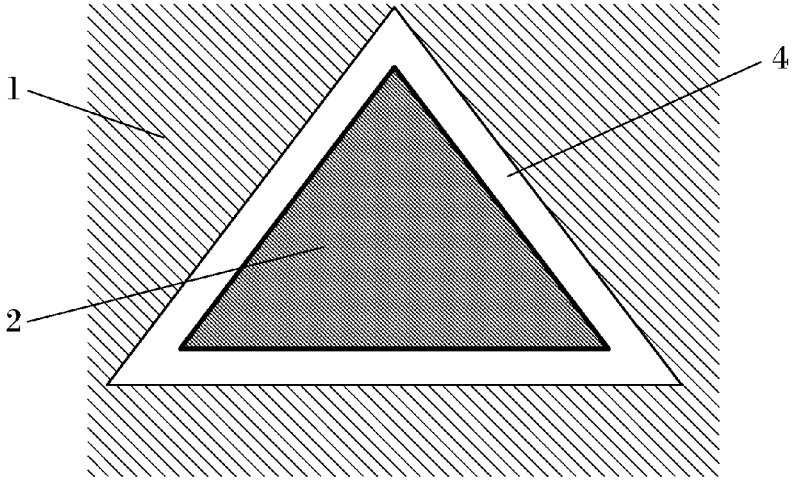
Figure 4J:
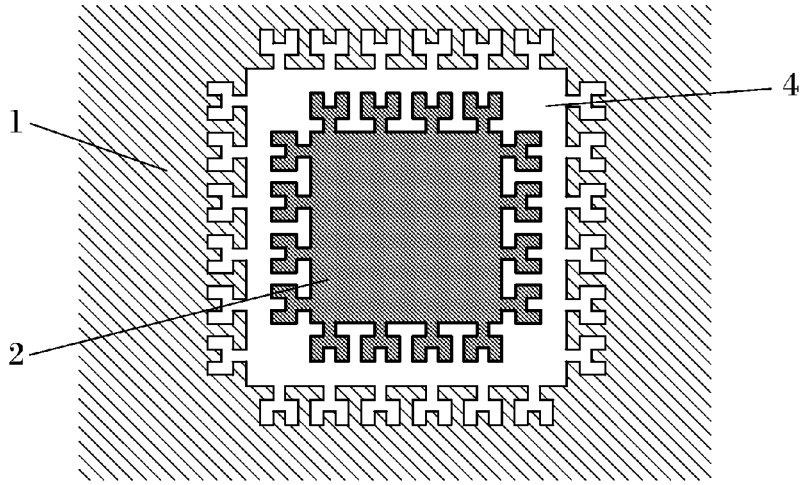

FIGS. 3 and 4 show one embodiment of the flush-mounted low-profile antenna. In this embodiment the radiating element (2) has no direct contact with the feeding system (5), for that, the radiating element is supported on a low-loss dielectric carrier (8) provided inside the resonant hole (4) as shown in FIGS. 6(*a*) and (*c*).

This dielectric carrier (8) can be used in such a way (basically by choosing its dielectric constant) that fills the resonant hole (4) completely. This may be used for tuning the flush-mounted low-profile resonant hole antenna to lower frequencies, or for reducing the overall flush-mounted low-profile resonant hole antenna dimensions, operating at the same frequency as per the flush-mounted low-profile resonant hole antenna with the resonant hole but not filled with low-loss dielectric material.

FIG. 5*a* through 5*c* present sectional views of possible embodiments of the flush-mounted low-profile resonant hole antenna. In the embodiment of FIG. 5*a* the resonant hole (4) and the radiating element (2) have a circular configuration. The radiating element (2) is flat and it is lying on the same plane as a flat part of the surface (1) of the fuselage (3) of aircraft, UAV or missile, that is, it is substantially coplanar with the surface (1). The bottom wall (7) and the radiating element (2) are flat and parallel to each other. A separation gap (11) is defined between the radiating element (2) and the fuselage (3), wherein the separation gap (11) extends all around the radiating element (2).

In the case of FIG. 5, the frequency range of operation is accomplished by the diameter of the resonant hole (4), and the dimensions of the radiating element (2). The antenna bandwidth is determined by the resonant hole height (H) and the distance (D) between the coupling plate (10) and the radiating element (2).

It is not mandatory that the resonant hole and radiating element have a circular shape. Other geometric structures can be used for the resonant hole and the radiating element.

In the case that other geometries are used, the same procedure mentioned before in respect to FIGS. 3 and 4, for tuning the antenna to the correct frequency of operation and bandwidth can be used.

FIGS. 4*a* to 4*j* show several combination of shapes of the resonant recess and the radiating element, which may have a circular or a polygonal shape.

FIGS. 5*b* and 5*c* present a sectional view of other embodiments of the present invention, showing the main components of the flush-mounted low-profile resonant hole antenna. In this case, the flush-mounted low-profile resonant hole antenna is conformed to the shape of the surface (1) of the fuselage (3). In the case of FIG. 5*b*, the radiating element (2) is a curved surface and the curvature of this surface is a continuation of the curvature of the surface (1) of the fuselage (3). In the case of FIG. 5*c*, the radiating element (2) is also a curved surface, but in this case the radiating element is formed by several flat surfaces, and the bottom wall (7) is also formed by flat surfaces.

The embodiments of FIGS. 5*b* and 5*c*, are preferred for UAVs or missile with relative smaller size than bigger aircrafts where the flush-mounted low-profile resonant hole antenna presented in FIG. 5*a* could not be used. In the embodiments of FIGS. 5*b* and 5*c*, due to the conformed shape of the flush-mounted low-profile resonant hole antenna, the same procedures mentioned above regarding the use of a dielectric carrier (8) for tuning the antenna to the correct frequency of operation and bandwidth can be used.

It has to be kept in mind that due to the different shape of the resonant hole of the antenna, the distance between the coupling plate (10) and the radiating element (2), the radiating element (2) dimensions, resonant hole height (H) and the gap (11) between the radiating element (2) and the fuselage (3) may be different than a flush-mounted low-profile resonant hole antenna configured as in FIG. 5*a* with the same response in resonance frequency and bandwidth.

As mentioned before, the flush-mounted low-profile resonant hole antenna can be considered as an integral part of the manufacturing process of the fuselage of the aircraft, UAV or missile. This manufacturing process is illustrated in FIGS. 6*a* through 6*c*, with different sectional views of such a flush-mounted low-profile resonant hole antenna possible embodiments.

The resonant hole (4) is accomplished by means of a recess (12) on the material of the fuselage (3) created during the manufacturing process of the fuselage of the aircraft, UAV or missile. Within said recess (12) in the fuselage (3), the feeding system (5) protrudes from the base (7) of the resonant hole ensuring that there is no direct coupling between the feeding system and the fuselage of the aircraft, UAV or missile.

A non-conductive standard low-loss dielectric material (8) is used as a carrier for the radiating element (2), that is, the radiating element (2) is placed on top of the dielectric material (8) by well-known means. This non-conductive low-loss dielectric material (8) and the radiating element (2) are deposited on the recess (12) as a part of the manufacturing process, so there is no need to add an additional and external antenna element.

Figure 7:
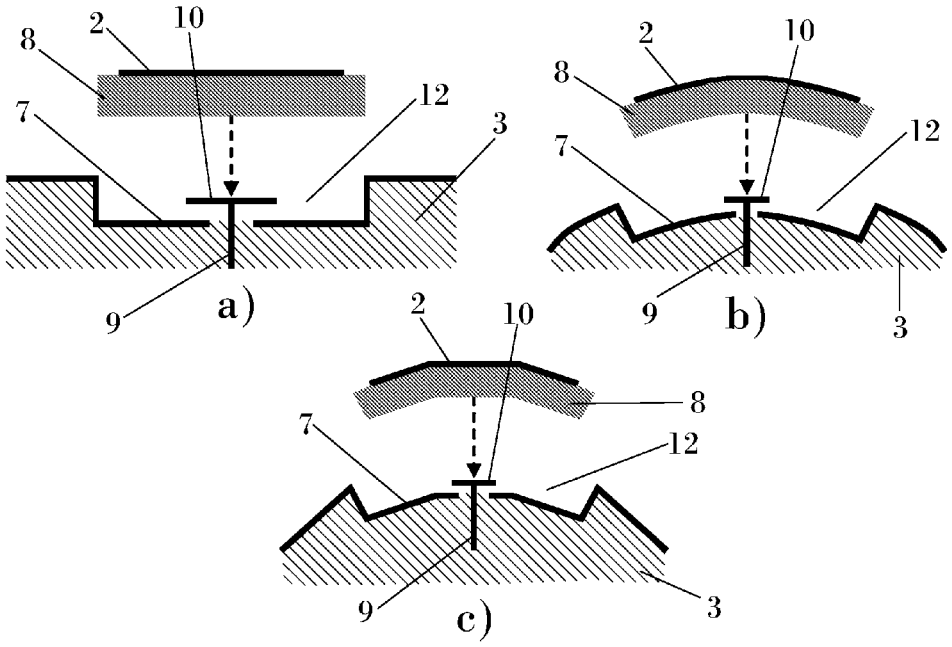
FIGS. 7*a* through 7*c* show different sectional views of the flush mounted low-profile resonant hole antenna and its main components. In this case the radiating element can be attached to the resonant hole as an additional component whereas the resonant hole and the feeding system is part of the fuselage of the aircraft, UAV or missile.

Another embodiment of the present invention is presented in FIGS. 7*a* through 7*c*. In either of these embodiments, the antenna resonant hole is created making a recess on the material of the fuselage of the aircraft, UAV or missile by appropriate means, during the manufacturing process of the fuselage of the aircraft, UAV or missile. Creating a hole on the resonant hole base, the feeding system protrudes from the resonant hole base, assuming that there is not direct electrical contact between the feeding system and the fuselage of the aircraft, UAV or missile. In this case, the resonant hole is designed is such a way that a good mechanical attachment of the component comprised by a radiating element and low-loss dielectrical material carrier. This component comprised by a radiating element and low-loss dielectrical material is manufactured with correct materials in order to make it compatible with the mechanical, environmental, vibration and aerodynamic requirements of an aircraft, UAV or missile.

Figure 8:
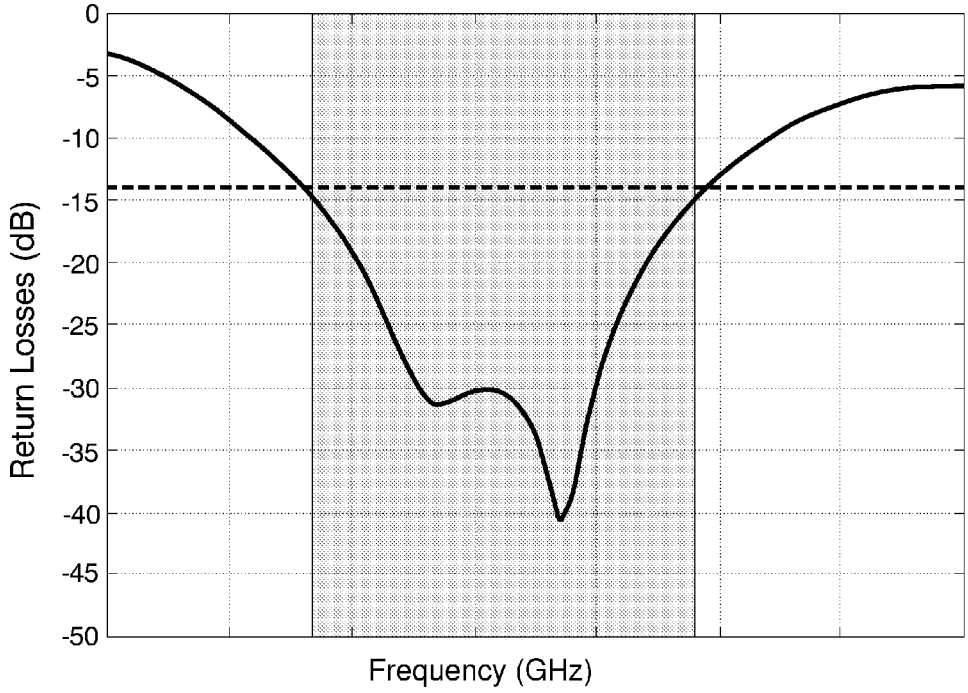
FIG. 8.—is the VSWR response of the flush-mounted low-profile resonant hole antenna of the previously represented embodiments.
Figure 9:
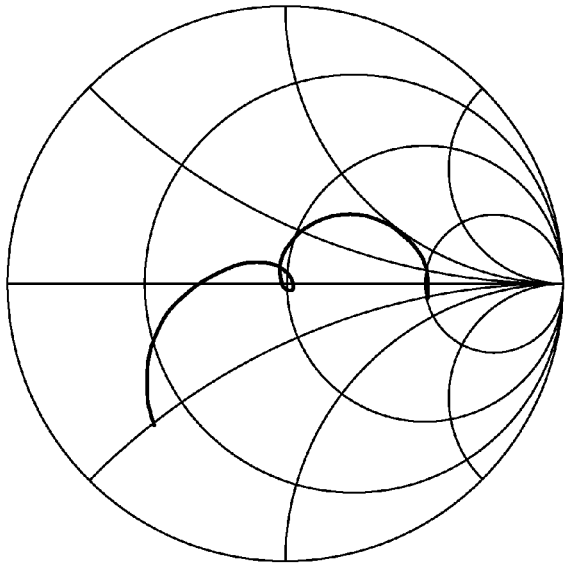
FIG. 9.—is the Smith Chart response of the flush-mounted low-profile resonant hole antenna of the previously represented embodiments.

FIGS. 8 and 9 present the flush-mounted low-profile resonant hole antenna performance in terms of VSWR and Smith chart. The flush-mounted low-profile resonant hole antenna bandwidth is controlled by means of the resonant hole height (H) and distance (D) between the coupling plate (10) of the feeding system and the radiating element (2).

The distance between the coupling plate (10) and the radiating element (2), particularly controls the coupling locus presented in FIG. 9. The resonance frequency of the flush-mounted low-profile resonant hole antenna is controlled by means of the dimension of the radiating element and therefore the dimensions of the antenna resonant hole.

The skilled in the art will understand that there are different possibilities to control the resonance frequency of the flush-mounted low-profile resonant hole antenna keeping its dimensions fixed.

These possibilities include:

(i) the use of low-loss dielectric materials (8) with different dielectric constant so a higher dielectric constant low-loss dielectric material changes the resonance frequency of the flush-mounted low-profile resonant hole antenna to lower frequencies keeping the same dimensions of the flush-mounted low-profile resonant hole antenna.

(ii) changing the geometry of the radiating element in such a way that the resonance frequency of the flush-mounted low-profile resonant hole antenna moves to the lower frequencies, keeping the same dimensions.

(iii) the use of a shorting element, so the radiating element is short-circuited to the bottom base (7) of the antenna resonant hole, so the resonance frequency can be controlled by this mean.

These possibilities also include any combination between the different methods (i, iii) mentioned above.

Figure 10:
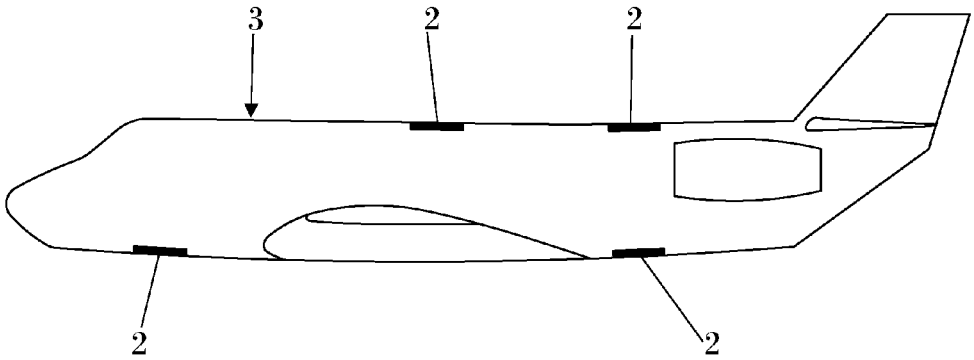
FIG. 10.—is a sectional view of an aircraft, showing potential positions for the flush-mounted low-profile resonant hole antenna.

FIG. 10 is a sectional view of an aircraft with different proposed positions of the flush-mounted low-profile resonant hole antenna. The flush-mounted low-profile resonant hole antenna performance is independent of the fuselage size, so it can be positioned on any desired position well suited for an optimum wiring of the aircraft. The mentioned above for the case of an aircraft is applicable to UAVs or missiles.

Figure 11:
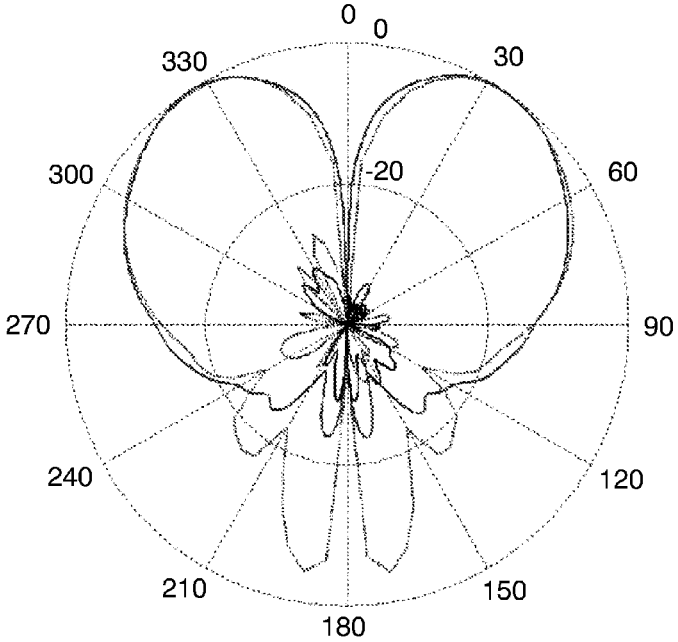
FIG. 11.—is the radiation pattern in the vertical plane response of the flush-mounted low-profile resonant hole antenna of the previously represented embodiments.
Figure 12:
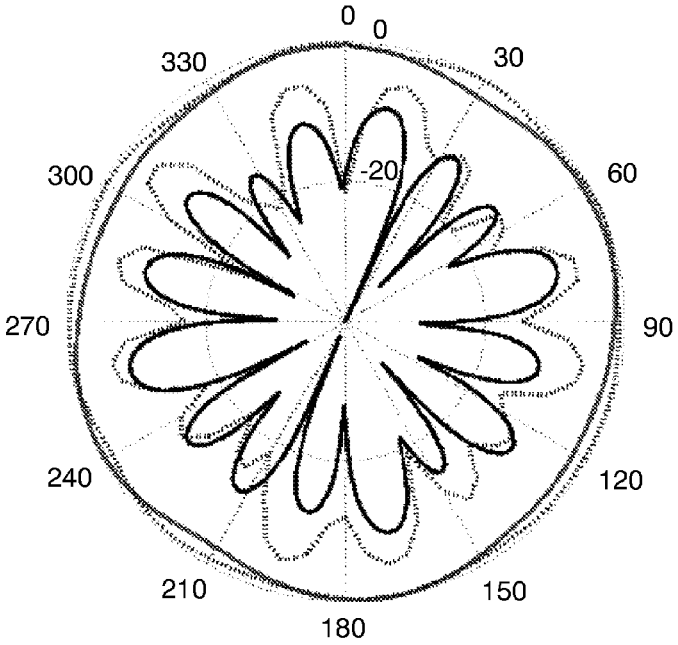
FIG. 12.—is the radiation pattern in the horizontal plane response of the flush-mounted low-profile resonant hole antenna of the previously represented embodiments.

FIGS. 11 and 12 show the radiation patterns of the flush-mounted low-profile resonant hole antenna positioned on either position on top of the fuselage of the aircraft, UAV or missile. The graphs present the vertical and horizontal components of the field and show that the flush-mounted low-profile resonant hole antenna presents vertical polarization behaviour, similar to standard blade antennas. On the other hand, the flush-mounted low-profile resonant hole antenna has an omnidirectional pattern on the horizontal plane.

The invention claimed is:

1. A portion of a fuselage of a flying artifact, the portion of the fuselage comprising:

a conducting surface;

a resonant hole antenna system comprising a resonant recess formed in the conducting surface, the resonant recess comprising an aperture in the conducting surface, the resonant recess filled at least partially with a dielectric material, a radiating element supported by the dielectric material, the radiating element having a top surface and a perimeter, the radiating element being disposed in the aperture, the top surface being mounted flush with the conducting surface, the perimeter being spaced from an peripheral edge of the aperture by a gap, the gap extending around the perimeter of the radiating element, a feeding element housed in the resonant recess and spaced from the radiating element, the feeding element being electromagnetically coupled with the radiating element for exciting the radiating element with an electromagnetic signal;

wherein the resonant recess comprises a first shape and the radiating element comprises a second shape, the first shape and the second shape being resonant in a predetermined operating frequency.

2. The portion of the fuselage of claim 1, wherein the feeding element is capacitively coupled to said radiating element.

3. The portion of the fuselage of claim 1, wherein the conducting surface comprises a conductive material, the conductive material being carbon fiber, aluminum, or titanium.

4. The portion of the fuselage of claim 1, wherein the first shape comprises a substantially circular configuration or a substantially polygonal configuration.

5. The portion of the fuselage of claim 1, wherein the first shape comprises a circular shape with a radius smaller than 1.5 wavelengths.

6. The portion of the fuselage of claim 1, wherein the antenna system is configured to provide a vertical polarization behaviour.

7. The portion of the fuselage of claim 1, wherein the antenna system is configured to have an omnidirectional pattern on the horizontal plane.

8. The portion of the fuselage of claim 1, wherein the radiating element is circular.

9. The portion of the fuselage of claim 1, wherein the radiating element comprises a planar or curved surface.

10. The portion of the fuselage of claim 1, wherein the radiating element is electrically isolated from the conducting surface.

11. The portion of the fuselage of claim 1, wherein the radiating element comprises a laminar body.

12. In combination, a portion of a fuselage of a flying artifact and a resonant hole antenna system;

the portion of the fuselage comprising a conducting surface;

the resonant hole antenna system comprising a resonant recess formed in the conducting surface, the resonant recess comprising an aperture in the conducting surface, the resonant recess filled at least partially with a dielectric material, a radiating element supported by the dielectric material, the radiating element having a top surface and a perimeter, the radiating element being disposed in the aperture, the top surface being mounted flush with the conducting surface, the perimeter being spaced from an peripheral edge of the aperture by a gap, the gap extending around the perimeter of the radiating element, a feeding element housed in the resonant recess and spaced from the radiating element, the feeding element being electromagnetically coupled with the radiating element for exciting the radiating element with an electromagnetic signal;

wherein the resonant recess comprises a first shape and the radiating element comprises a second shape, the first shape and the second shape being resonant in a predetermined operating frequency.

13. The combination of claim 12, wherein the radiating element comprises a laminar body.

14. A flying artifact comprising:

a fuselage comprising a conducting surface;

a resonant hole antenna system comprising a resonant recess formed in the conducting surface, the resonant recess comprising an aperture in the conducting surface, the resonant recess filled at least partially with a dielectric material, a radiating element supported by the dielectric material, the radiating element having a top surface and a perimeter, the radiating element being disposed in the aperture, the top surface being mounted flush with the conducting surface, the perimeter being spaced from an peripheral edge of the aperture by a gap, the gap extending around the perimeter of the radiating element, a feeding element housed in the resonant recess and spaced from the radiating element, the feeding element being electromagnetically coupled with the radiating element for exciting the radiating element with an electromagnetic signal;

wherein the resonant recess comprises a first shape and the radiating element comprises a second shape, the first shape and the second shape being resonant in a predetermined operating frequency;

wherein the flying artifact is an airplane, an helicopter, a missile or an UAV vehicle.

15. The flying artifact of claim 14, wherein the radiating element comprises a laminar body.

* * * * *